US008340555B2

(12) United States Patent
Naoi et al.

(10) Patent No.: US 8,340,555 B2
(45) Date of Patent: Dec. 25, 2012

(54) TONER SUPPLY CONTAINER AND IMAGE FORMING APPARATUS

(75) Inventors: Shinya Naoi, Toyokawa (JP); Hiroshi Tanimoto, Toyokawa (JP); Yasuaki Tomoda, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 0 days.

(21) Appl. No.: 12/793,804

(22) Filed: Jun. 4, 2010

(65) Prior Publication Data

US 2010/0310278 A1 Dec. 9, 2010

(30) Foreign Application Priority Data

Jun. 8, 2009 (JP) ..... 2009-137462

(51) Int. Cl.
*G03G 15/08* (2006.01)

(52) U.S. Cl. ..... 399/263; 366/320

(58) Field of Classification Search ..... 399/119, 399/252, 254, 255, 258, 262, 263, 256; 366/320, 366/323

See application file for complete search history.

(56) References Cited

U.S. PATENT DOCUMENTS 5,374,977 A * 12/1994 Shiina et al.
5,682,584 A * 10/1997 Hattori et al. ..... 399/255
2002/0127032 A1* 9/2002 Ban et al. ..... 399/262
2008/0170885 A1* 7/2008 Hatakeyama et al. ..... 399/254

FOREIGN PATENT DOCUMENTS

JP 10247009 A * 9/1998
JP 2000098736 A * 4/2000
JP 2000181213 A * 6/2000
JP 2005-099593 A 4/2005

* cited by examiner

*Primary Examiner* — Walter L Lindsay, Jr.
*Assistant Examiner* — Milton Gonzalez
(74) *Attorney, Agent, or Firm* — Buchanan Ingersoll & Rooney PC

(57) ABSTRACT

A toner supply container has a container body and a conveyance member rotatably arranged inside the container body and which conveys toner toward a discharge opening of the container body when driven to rotate by external force. The conveyance member includes a cylindrical rotary body and a screw blade member wound around the cylindrical rotary body so that the screw blade member stands on an outer circumferential surface of the cylindrical rotary body. The inner surface of a bottom wall of the container body includes a cylindrically curved surface identical to a part of a circumferential surface of an imaginary cylinder whose axis is substantially the same as a rotation axis of the conveyance member. A curvature radius of the cylindrically curved surface is set so the conveyance member rotates in a state where an outer circumferential edge of the screw blade member substantially slides on the cylindrically curved surface.

12 Claims, 5 Drawing Sheets

TONER SUPPLY CONTAINER AND IMAGE FORMING APPARATUS

This application is based on application No. 2009-137462 filed in Japan, the content of which is hereby incorporated by reference.

BACKGROUND OF THE INVENTION (1) Field of the Invention

The present invention relates to an electrophotographic image forming apparatus, and in particular to a toner supply container for supplying toner to a developer in the image forming apparatus.

(2) Description of the Related Art

In general, in an electrophotographic image forming apparatus, such as a fax machine, copying machine, and printer, image formation is performed in the following manner. A developer supplies toner to an electrostatic latent image formed on a photoreceptor to develop the electrostatic latent image, and the developed toner image is transferred onto a recording sheet and thermally fixed to the recording sheet.

Usually, the toner is stored in a large-capacity toner supply container, and the toner supply container is configured to supply only a required amount of toner to the developer according to toner consumption.

At the time, an amount of toner to be supplied from the toner supply container to the developer needs to be accurately controlled. This is because an insufficient amount of toner results in poor image formation due to a lack of toner in the developer, while an excessive amount of toner results in a problem like a toner jam.

Consequently, in the conventional technology, it is common to separately provide a toner supply mechanism capable of quantitatively controlling supply of toner in a supply channel from the toner supply container to the developer. For example, Japanese Patent Application Publication No. 2005-99593 (Patent Document 1) discloses a structure in which a coil spring that has approximately the same diameter as an inner diameter of the supply channel is provided in the supply channel from the toner supply container to the developer. And, by controlling rotation of the coil spring, an amount of toner supplied to the developer is adjusted.

However, with the above-mentioned structure disclosed in Patent Document 1, in order to supply toner to the developer, there is a need to provide (i) a first mechanism for discharging toner from the toner supply container to the supply channel, and (ii) a second mechanism for supplying the discharged toner to the developer while quantitatively controlling supply thereof. This structure prevents an apparatus from being downsized. In addition, it becomes an obstacle to reducing cost because many components and many assembly processes are required.

SUMMARY OF THE INVENTION

One aspect of the present invention is a toner supply container comprising: a container body that contains toner therein; and a conveyance member that is rotatably arranged inside the container body and conveys the toner toward a discharge opening of the container body when driven to rotate by external force, wherein the conveyance member includes (i) a cylindrical rotary body and (ii) a screw blade member that is wound around the cylindrical rotary body in such a manner that the screw blade member stands on an outer circumferential surface of the cylindrical rotary body, an inner surface of a bottom wall of the container body includes a cylindrically curved surface that is identical to a part of a circumferential surface of an imaginary cylinder whose axis is substantially the same as a rotation axis of the conveyance member, and a curvature radius of the cylindrically curved surface is set such that the conveyance member is driven to rotate in a state where an outer circumferential edge of the screw blade member substantially slides on the cylindrically curved surface.

BRIEF DESCRIPTION OF THE DRAWINGS

These and the other objects, advantages and features of the invention will become apparent from the following description thereof taken in conjunction with the accompanying drawings that illustrate a specific embodiment of the invention.

In the drawings.

DESCRIPTION OF THE PREFERRED EMBODIMENT

The following describes an embodiment of an image forming apparatus pertaining to the present invention, the image forming apparatus specifically being a tandem-type color digital printer (hereinafter, simply referred to as a "printer") as an example.

1-1. Overall Structure of Printer

Figure 1:
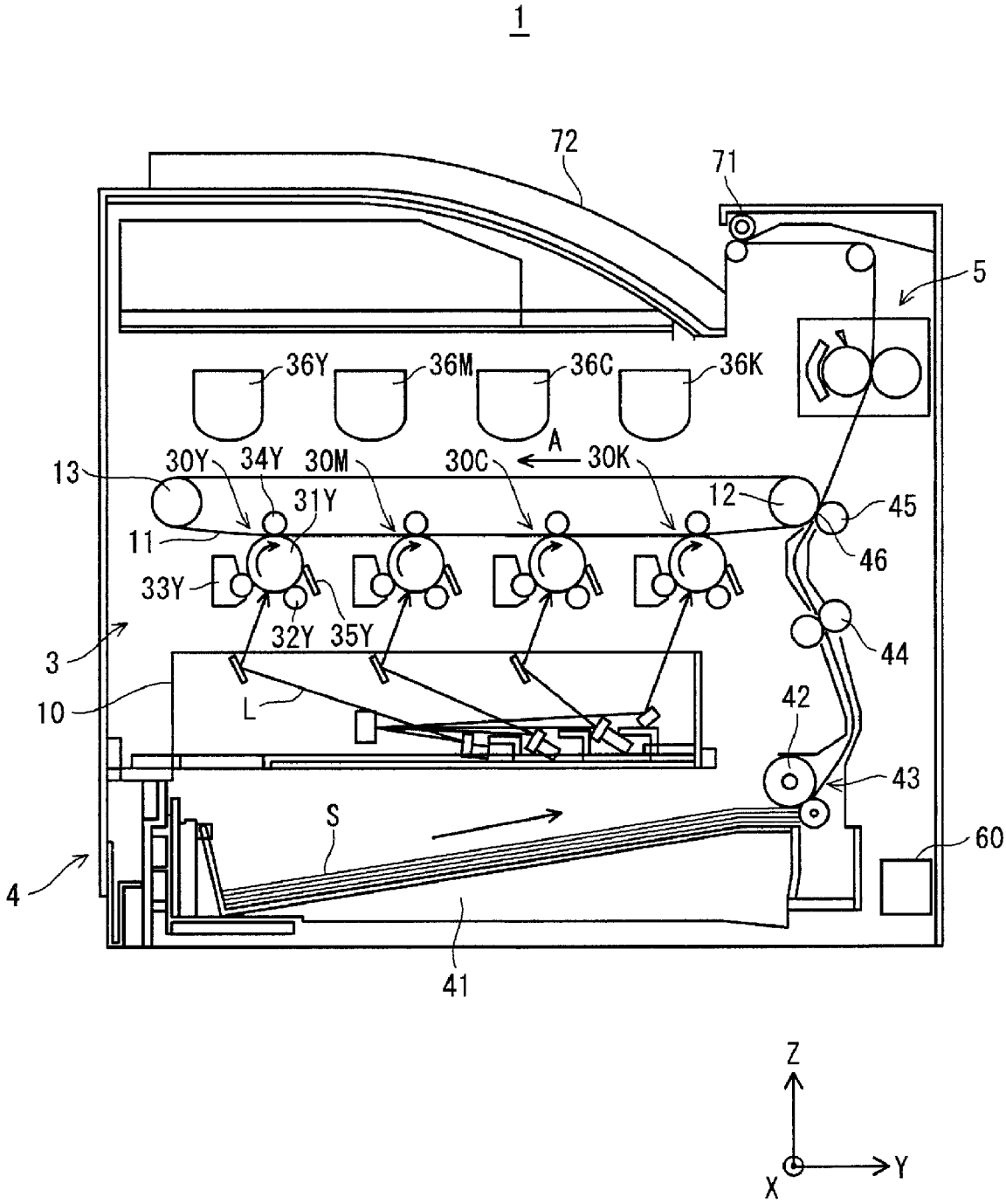
FIG. 1 is a cross-sectional view showing an overall structure of an image forming apparatus pertaining to an embodiment of the present invention.

FIG. 1 is a schematic cross-sectional view showing an overall structure of a printer 1 pertaining to the embodiment of the present invention. As shown in FIG. 1, the printer 1 includes an image processor 3, a paper feeder 4, a fixing part 5, and a controller 60. The printer 1 is connected to a network (e.g. LAN). Upon receiving an instruction to execute a print job from an external terminal device (not illustrated), the printer 1 forms toner images of colors yellow, magenta, cyan, and black, respectively, based on the instruction, and performs full color image formation by multi-transferring the formed toner images. Hereinafter, reproduction colors of the yellow, magenta, cyan, and black are represented as Y, M, C, and K, respectively. The letters Y, M, C, and K are appended to reference numbers of components relating to the yellow, magenta, cyan, and black, respectively.

1-2. Structure of Image Processor

The image processor 3 includes imaging parts 30Y, 30M, 30C, and 30K that correspond to colors of Y, M, C, and K, respectively, an optical part 10, an intermediate transfer belt 11 and so on.

The imaging part 30Y includes a photosensitive drum 31Y, and also includes a charger 32Y, a developer 33Y, a primary transfer roller 34Y, a cleaner 35Y for cleaning the photosensitive drum 31Y, and a toner supply container 36Y that are provided around the photosensitive drum 31Y. The imaging part 30Y forms a toner image of Y color on the photosensitive drum 31Y.

Since the other imaging parts 30M, 30C, and 30K have structures similar to the structure of the imaging part 30Y, reference numbers of these components included in the other imaging parts 30M, 30C, and 30K are omitted in FIG. 1.

The intermediate transfer belt 11 is an endless belt that is bridged in a tensioned state between a driving roller 12 and a driven roller 13, and is driven to rotate in a direction of an arrow A.

The optical part 10 includes a light emitting element, such as a laser diode. The optical part 10 emits laser light L and performs exposure scanning on the photosensitive drums 31Y, 31M, 31C, and 31K to form images of Y, M, C, and K colors, respectively, by a drive signal transmitted from the controller 60.

After the exposure scanning, electrostatic latent images are formed on the photosensitive drums 31Y, 31M, 31C, and 31K having been charged by the chargers 32Y, 32M, 32C, and 32K, respectively.

The toner supply containers 36Y, 36M, 36C, and 36K contain toner of Y, M, C and K colors, respectively. The toner supply containers 36Y, 36M, 36C, and 36K supply toner to the developers 33Y, 33M, 33C, and 33K, respectively.

Figure 2:
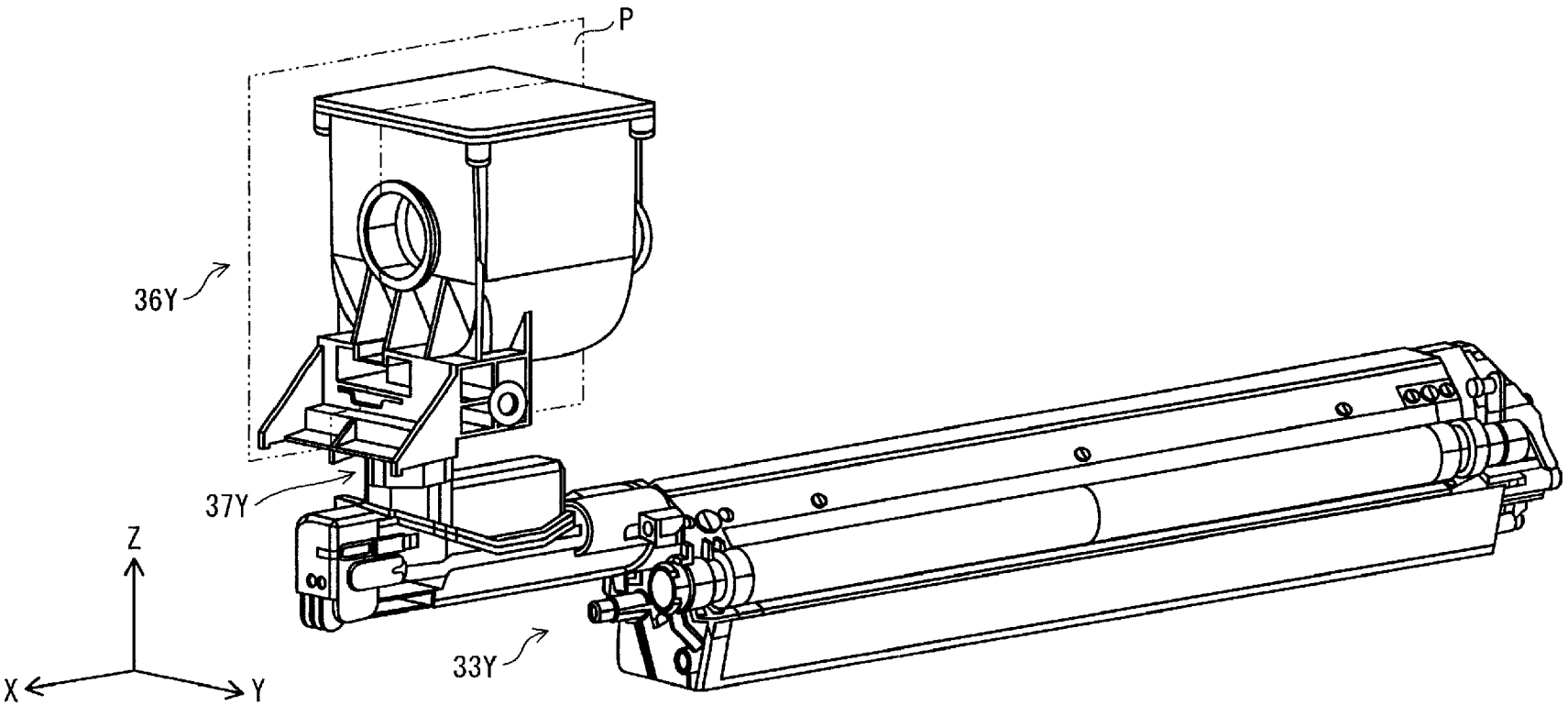
FIG. 2 is a perspective view showing a general configuration of a toner supply container and a developer pertaining to the embodiment of the present invention.

Here, the toner supply containers 36Y, 36M, 36C, and 36K are connected to the developers 33Y, 33M, 33C, and 33K, respectively, via toner supply channels 37Y, 37M, 37C, and 37K (see FIG. 2). The toner supply containers 36Y, 36M, 36C, and 36K supply toner via the toner supply channels 37Y, 37M, 37C, and 37K, respectively.

Since electrostatic latent images formed on the photosensitive drums 31Y, 31M, 31C, and 31K are developed by the developers 33Y, 33M, 33C, and 33K to form toner images of Y, M, C, and K colors, each of the electrostatic latent images is formed at a different timing so that toner images of Y, M, C, and K colors are primary-transferred onto the same position of the intermediate transfer belt 11 in layers.

Toner images of Y, M, C, and K colors are sequentially transferred onto the intermediate transfer belt 11 by electrostatic force from the primary transfer rollers 34Y, 34M, 34C, and 34K. These toner images form a full color toner image as a whole. Then, the formed full color toner image is conveyed to a secondary transfer position 46.

The paper feeder 4 includes a paper feed cassette 41 that stores a recording sheet S, a reel roller 42 that reels the recording sheet S stored in the paper feed cassette 41 one sheet at a time to a conveyance path 43, a timing roller pair 44 that measures a timing of conveying the reeled-out recording sheet S to the secondary transfer position 46, and so on. The recording sheet S is conveyed from the paper feeder 4 to the secondary transfer position 46 in accordance with a timing at which toner images formed on the intermediate transfer belt 11 are conveyed. The full color toner image formed on the intermediate transfer belt 11 is secondary-transferred onto the recording sheet S.

After passing the secondary transfer position 46, the recording sheet S is conveyed via conveying roller 45 to the fixing part 5. Then the full color toner image (unfixed image) formed on the recording sheet S is fixed on the recording sheet S by the fixing part 5 applying heat and pressure to the recording sheet S, and the recording sheet S is ejected onto a receiving tray 72 via a pair of ejecting rollers 71.

1-3. Structure of Toner Supply Container 36Y

FIG. 2 is a perspective view showing the toner supply container 36Y attached to the developer 33Y.

As shown in FIG. 2, the toner supply container 36Y is positioned above one end of the developer 33Y in X direction.

Figure 3:
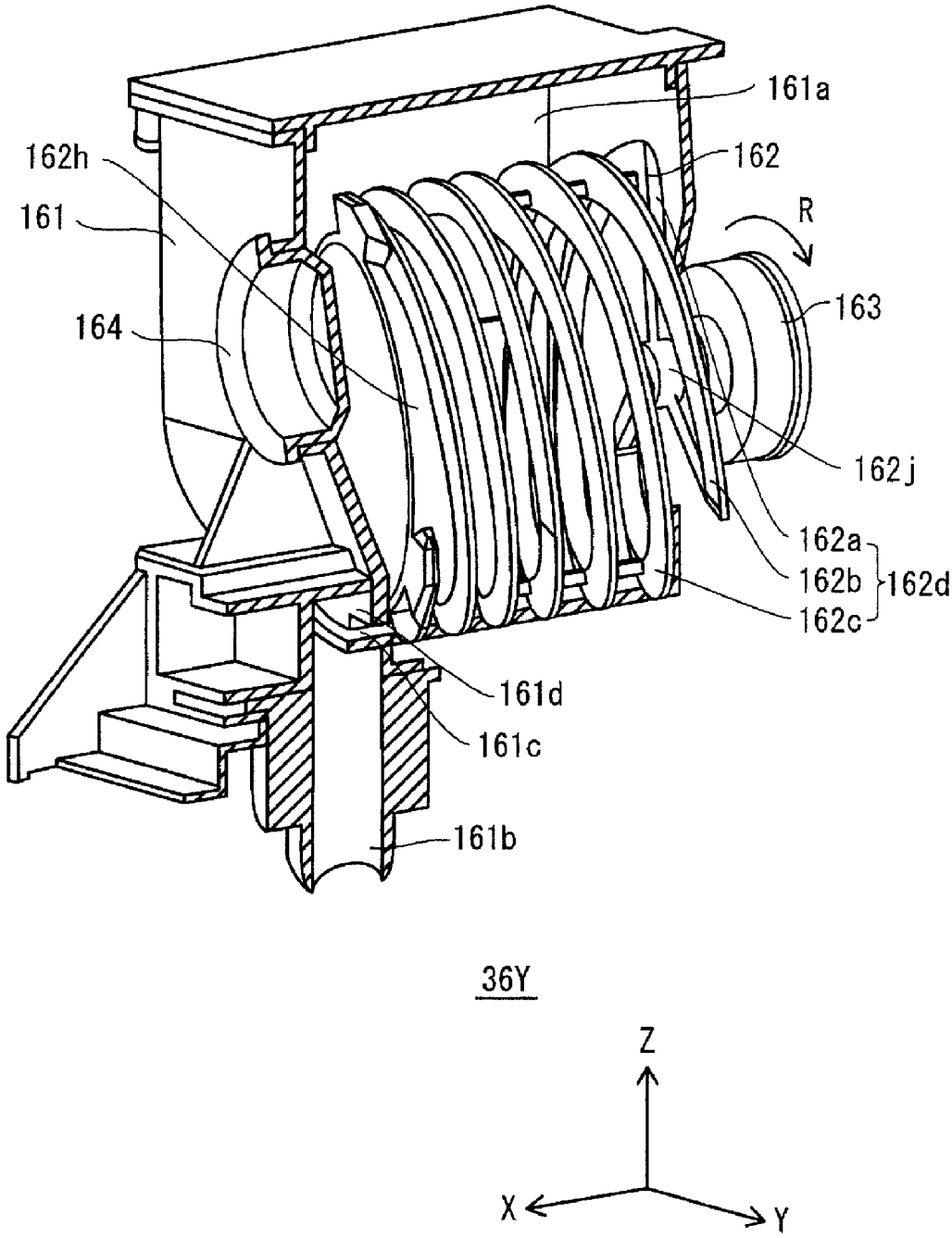
FIG. 3 is a partially cutout perspective view showing a general configuration of the toner supply container pertaining to the embodiment of the present invention.

FIG. 3 is a partially cutout perspective view of the toner supply container 36Y. In FIG. 3, a container part of the toner supply container 36Y other than a coil screw 162 is cut along an imaginary plane P shown in FIG. 2.

As shown in FIG. 3, the toner supply container 36Y includes a toner supply container body 161, the coil screw 162, a coupling member 163, and a cap 164.

Note that, before the toner supply container 36Y is attached to the apparatus, toner is put into the toner supply container body 161 in a state where the cap 164 side of the toner supply container 36Y is turned up, with the cap 164 being removed. In this embodiment, since a space inside the coil screw 162 provides the largest toner storage space in the toner supply container body 161, the toner supply container body 161 can be effectively filled with toner in the above-mentioned way.

The toner supply container body 161 includes a toner container 161*a* and a toner supply route 161*b*. They are partitioned by a vertical wall 161*d* in which a discharge opening 161*c* (see FIG. 5B) is formed.

The coupling member 163 is connected via a connector 200 to a drive axis (not illustrated) provided in a body of the printer 1, and transmits its rotary force to the coil screw 162.

A tip of an axis 163*c* (see FIG. 5A) of the coupling member 163 is inserted, from outside, into a bearing hole (not illustrated) formed in a side wall 161*s* that is positioned on a –X side of the toner supply container body 161. The axis 163*c* is connected to an end supporter 162*j* of the coil screw 162 (described later) inside the toner supply container body 161. Note that the axis 163*c* is tightly and rotatably inserted into the bearing hole so that toner contained in the toner supply container body 161 does not leak from the bearing hole. The axis 163*c* transmits rotary force of the drive axis provided in the body of the printer 1 to the coil screw 162, and rotates the coil screw 162 in a direction of an arrow R.

Figure 4:
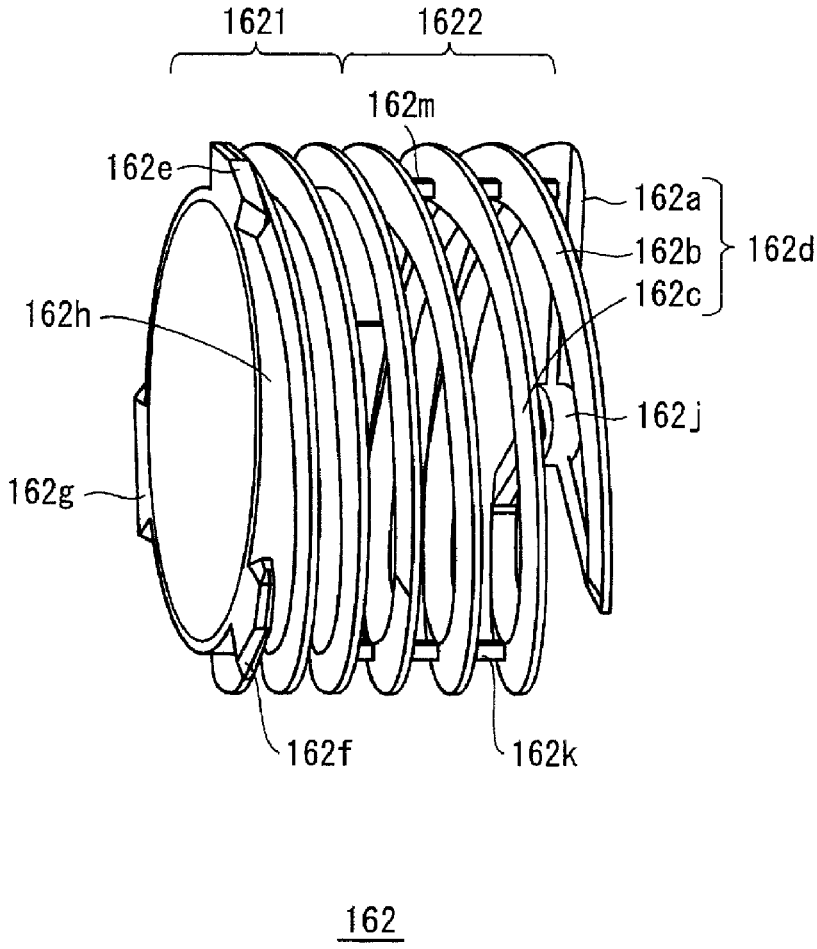
FIG. 4 is a perspective view of a coil screw pertaining to the embodiment of the present invention.

FIG. 4 is a perspective view showing the coil screw 162.

As shown in FIG. 4, the coil screw 162 conveys toner in X direction (hereinafter, referred to as "toner conveyance direction") when driven to rotate by external force in the direction of the arrow R (see FIG. 3). The coil screw 162 includes a cylindrical part 162*h*, a triple helix part 162*d*, shields 162*e*, 162*f* and 162*g*, and the end supporter 162*j*. The cylindrical part 162*h* is a hollow cylinder.

The triple helix part 162*d* is composed of three helical blades 162*a*, 162*b* and 162*c* that revolve in the same direction and are phase shifted by 120 degrees with each other. The triple helix part 162*d* is wound around the cylindrical part 162*h* so as to stand on an outer circumferential surface of the cylindrical part 162*h*. The cylindrical part 162*h* is composed of (i) a first cylindrical part 162*h*1 that is located in a first area 1621 and includes an end of the cylindrical part 162*h* in X direction, and (ii) a second cylindrical part 162*h*2 that is located in a second area 1622 and is formed integrally with the first cylindrical part 162*h*1 so as to be adjacent to a –X side of the first cylindrical part 162*h*1. The first cylindrical part 162*h*1 has a continuous circumferential surface without openings. A circumferential surface of the second cylindrical part 162*h*2 on which the triple helix part 162*d* is not formed is opened, and thus there are openings between adjacent blades. In a part of the triple helix part 162*d* formed to stand on the outer circumferential surface of the second cylindrical part 162*h*2 (i.e. a part in the second area 1622), adjacent blades are reinforced by being connected via ribs 162*k* and 162*m* that are positioned substantially parallel with a rotation axis. Thus a helical shape and a pitch (intervals between adjacent blades) of the triple helix part 162*d* are maintained constant. Note that the ribs 162*k* and 162*m* can be omitted when the triple helix part 162*d* is made of a material that has enough strength to maintain the helical shape and the pitch thereof without such ribs.

At upstream ends of the blades 162*a*, 162*b* and 162*c* of the triple helix part 162*d* in the toner conveyance direction, the end supporter 162*j* is formed to support the blades 162*a*, 162*b* and 162*c* and to connect the axis 163*c* (see FIG. 5A) of the above-mentioned coupling member 163.

A rectangular through-hole 162*n* (see FIG. 5B) is formed at the center of the end supporter 162*j*. The axis 163*c* of the coupling member 163 is tightly inserted into the through-hole 162*n*, and rotary driving force from the outside is transmitted to the coil screw 162 via the axis 163*c*.

The shields 162*e*, 162*f* and 162*g* are formed on the other ends (downstream ends in the toner conveyance direction) of the blades 162*a*, 162*b* and 162*c* of the triple helix part 162*d*, respectively. One of the shields 162*e*, 162*f* and 162*g* occludes the above-mentioned discharge opening 161*c* when the coil screw 162 is in a predetermined rotational position so as to prevent toner from flowing out.

Figure 5B:
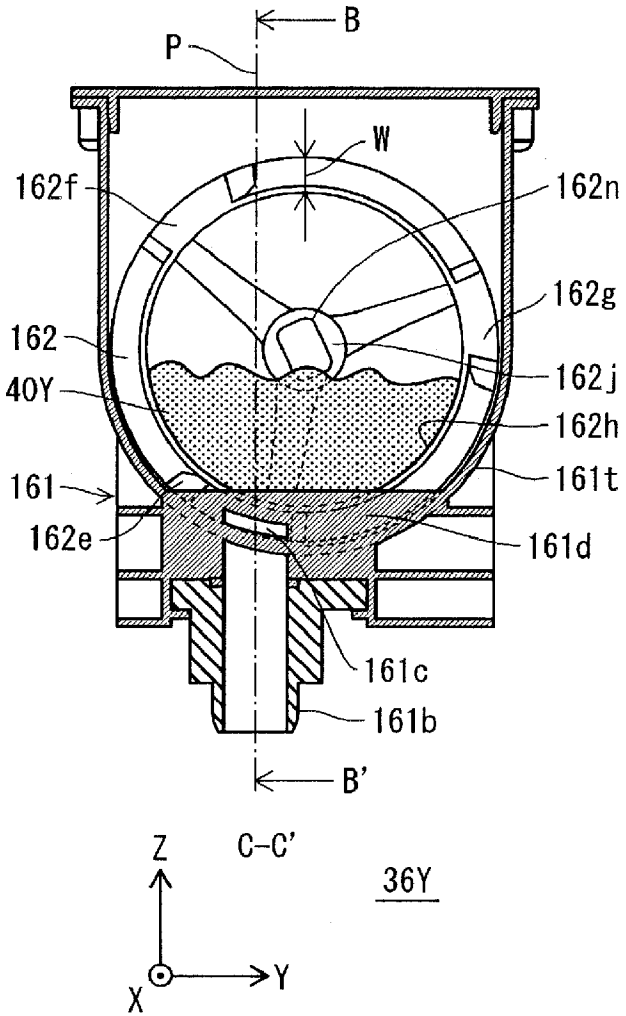
FIG. 5B is a cross-sectional view of the toner supply container pertaining to the embodiment of the present invention when the toner supply container is viewed from the front.

Also, as shown in FIG. 5B (described later), when the toner supply container body 161 is cut along a plane perpendicular to a rotation axis of the coil screw 162, a bottom surface of the toner supply container body 161 is semi-circular in cross section (hereinafter, referred to as a "half cylindrical part 161*t*") and a center of the semicircle is the same as that of the rotation axis of the coil screw 162. A curvature radius of the half cylindrical part 161*t* is set such that the coil screw 162 can rotate in a state where outer circumferential edges of the blades 162*a*, 162*b* and 162*c* of the triple helix part 162*d* slide on an inner surface of the half cylindrical part 161*t*.

Figure 5A:
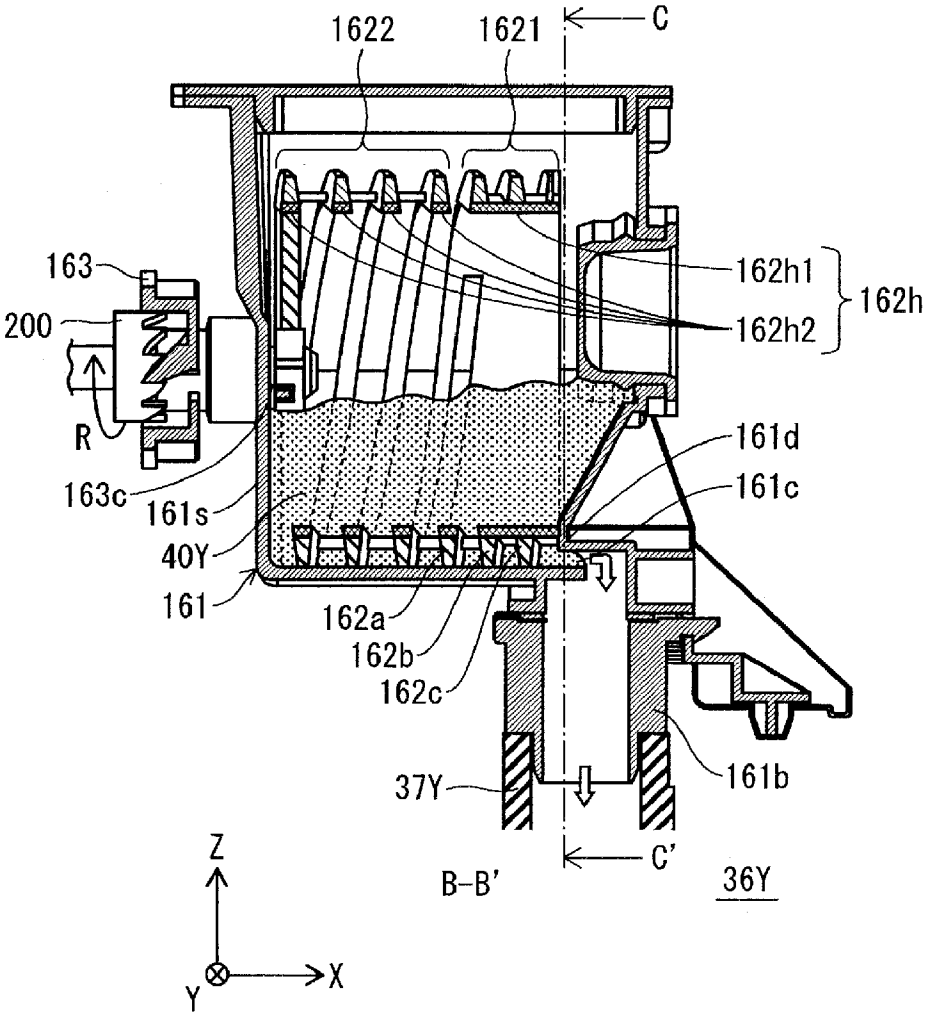
FIG. 5A is a cross-sectional view of the toner supply container pertaining to the embodiment of the present invention when the toner supply container is viewed from the side.

FIG. 5A is a cross-sectional view of the toner supply container 36Y viewed from −Y side, when the toner supply container 36Y is cut along the imaginary plane P shown in FIG. 2. FIG. 5B is a cross-sectional view of the toner supply container 36Y, when the toner supply container 36Y is cut along line C-C' shown in FIG. 5A.

As shown in FIG. 5A, a circumferential surface of the second cylindrical part 162*h*2 on which the triple helix part 162*d* is not formed is opened, and thus there are openings between adjacent blades. Therefore, toner 40Y existing inside the second cylindrical part 162*h*2 freely flows through spaces between adjacent blades, and is conveyed in X direction by the blades 162*a*, 162*b*, and 162*c*.

An amount of the toner 40Y having been conveyed to the first area 1621 is regulated within a space surrounded by an outer circumferential surface of the first cylindrical part 162*h*1 in the first area 1621, adjacent blades of the triple helix part 162*d*, and an inner surface of the half cylindrical part 161*t* in the toner supply container body 161. While being regulated, the toner 40Y is conveyed to the vertical wall 161*d* at an end of the coil screw 162 in X direction by rotation of the coil screw 162, and discharged from the discharge opening 161*c* to the toner supply route 161*b*.

The discharged toner 40Y is supplied to the developer 33Y (see FIG. 2) via the toner supply channel 37Y that is connected below the toner supply route 161*b*.

As shown in FIG. 5B, the discharge opening 161*c* is formed in the vertical wall 161*d* in an area between the outer circumferential surface of the first cylindrical part 162*h*1 and the inner surface of the half cylindrical part 161*t* in the container body. In particular, a lower rim of the discharge opening 161*c* is flush with the inner surface of the half cylindrical part 161*t* so that toner is smoothly discharged.

Also, an end of the cylindrical part 162*h* in X direction is on an imaginary plane that is substantially perpendicular to the rotation axis of the cylindrical part 162*h*, and an inner wall of the vertical wall 161*d* of the container body is on the imaginary plane that is substantially perpendicular to the rotation axis of the cylindrical part 162*h*. Dimension of the coil screw 162 in a direction of the rotation axis is determined such that the cylindrical part 162*h* rotates in a state where the end of the cylindrical part 162*h* in X direction substantially slides on the vertical wall 161*d*.

As described above, with a structure in which the toner 40Y is trapped and conveyed in a space surrounded by adjacent blades of the triple helix part 162*d*, an outer circumferential surface of the first cylindrical part 162*h*1, and an inner surface of the half cylindrical part 161*t*, and discharged from the discharge opening 161*c*, an amount of toner discharged from the discharge opening 161*c* per unit rotation (e.g. one rotation) of the coil screw 162 is maintained substantially constant. Therefore, an amount of supplied toner can be precisely controlled by controlling a rotation of the coil screw 162.

Note that, in this embodiment, a pitch of the triple helix part 162*d* in the second area 1622 is set to be greater than that in the first area 1621. This is for increasing upstream conveyance force so that more toner is distributed downstream in the toner conveyance direction in the toner supply container 36Y, and for stably discharging toner from the discharge opening 161*c*. However, the pitch of the triple helix part 162*d* in the first area 1621 is preferred to be constant. The reason is as follows. In the first area 1621, toner is trapped in the space surrounded by an outer circumferential surface of the first cylindrical part 162*h*1, adjacent blades of the triple helix part 162*d* and an inner surface of the half cylindrical part 161*t*, and the toner cannot move between inside and outside of the first cylindrical part 162*h*1. If the pitch is not constant, it is considered to become difficult to appropriately control an amount (weight) of discharged toner because toner density may change due to unnecessary pressure applied to the toner trapped in the space.

Also, as seen from FIG. 5B, the discharge opening 161*c* is positioned slightly downstream in a direction of rotation relative to a position vertically bellow the rotation axis of the coil screw 162. With this structure, an amount of supplied toner can be stabilized even when a draft line of the toner is inclined with a little toner left in the toner supply container body 161.

Here, a ratio between a diameter of the cylindrical part 162*h* and a width of each blade of the triple helix part 162*d* (a length from an outer circumferential surface of the cylindrical part 162*h* to an edge line of the triple helix part 162*d* in a direction perpendicular to the outer circumferential surface of the cylindrical part 162*h*) is considered as follows. When the width w of each blade (see FIG. 5B) is too small, adequate conveyance force cannot be obtained. On the other hand, when the width w of each blade is too large, toner is not stably discharged because the diameter of the cylindrical part 162*h* becomes relatively small, and the toner 40Y existing in a repose angle of the discharge opening 161*c* is transferred to and flown out from the discharge opening 161*c* due to its own weight.

In view of the above, when the ratio between the width of each blade of the triple helix part 162*d* and an outer diameter of the cylindrical part 162*h* is denoted as k (=a width of each blade/an outer diameter of the cylindrical part 162*h*), it is desirable that k satisfy the relationship $0.06 \leqq k \leqq 0.17$.

Also, a range of a lead (a distance that is measured parallel to the rotation axis between corresponding points on the leading edge of one of the blades of triple helix part 162*d* in one revolution of the blade) of each blade of the triple helix part 162*d* is considered as follows. That is to say, when the lead is too small, the pitch is decreased. This may cause toner to be stuck in a space between the adjacent blades. The stuck toner is revolved with the coil screw 162, and the toner is not conveyed to the discharge opening 161*c*. Alternatively, the stuck toner sometimes collapses, and, as a result, more toner is conveyed to the discharge opening 161*c*. On the other hand, when the lead is too large, an amount of supplied toner may become unstable. This is because force of each blade to convey toner in a rotation direction becomes larger than force to convey toner in X direction, and force to push out and discharge toner from the discharge opening 161*c* is reduced.

In order to stably supply toner, when a ratio between a length of the lead and the outer diameter of the cylindrical part 162*h* is denoted as j (=a length of the lead/an outer diameter of the cylindrical part 162*h*), it is desirable that j satisfy the relationship $0.27 \leqq j \leqq 0.56$ in a case of a triple helix.

In this embodiment, a triple helix is used for blades that are formed to stand on an outer circumferential surface of the cylindrical part 162*h* of the coil screw 162. The reason is as follows. When the coil screw 162 is rotated by 360 degrees, a triple helix can reduce variability of a distance between the discharge opening 161*c* and an opposing blade surface compared to a single helix. As a result, variability of an amount of toner delivered to the discharge opening 161*c* per rotation angle of the coil screw 162 is reduced, and toner can be supplied more stably. From this point of view, a quadruple helix or more may be used. However, toner tends to be stuck because a pitch is decreased with this structure. With a structure in which an amount of supplied toner is controlled in units of a half rotation or one rotation of the coil screw 162, toner can be stably supplied even when a double or single helix is used.

As described above, since the first cylindrical part 162*h*1 serves as a partition to quantitatively supply toner, the first cylindrical part 162*h*1 needs to have enough length in a direction of a rotation axis. It is considered that the coil screw 162 in the first area 1621 serves a function to control an amount of discharged toner as long as at least a space surrounded by adjacent blades, an outer circumferential surface of the first cylindrical part 162*h*1 and an inner surface of the half cylindrical part 161*t* is continuous immediately before the discharge opening 161*c* in one rotation of the coil screw 162. Therefore, a length of the cylindrical part 162*h* in the direction of the rotation axis is desirable to be equal to one pitch (=length of the lead/number of threads) or more.

Note that the other toner supply containers 36C, 36M, and 36K have the same structure as that of the toner supply container 36Y except that colors of toner contained therein are different. Since the other toner supply containers 36C, 36M, and 36K have the same function as the toner supply container 36Y, explanations thereof are omitted.

The toner supply containers 36Y, 36M, 36C, and 36K having the above-mentioned structure are attached to the printer 1, the controller 60 controls and drives a motor (not illustrated), and an appropriate amount of toner is supplied to each developer.

That is to say, the controller 60 supplies a required amount of toner by obtaining toner consumption of each developer in a predetermined method, and rotating a coil screw in a corresponding toner supply container according to the obtained toner consumption. As described above, since the toner supply container in this embodiment can quantitatively supply toner according to rotation of the coil screw, it is possible to supply an appropriate amount of toner.

Note that toner consumption of each developer may be obtained by calculating a value of a dot counter, by installing a sensor that detects an amount of remaining toner in each developer and so on. However, since these methods are well known, explanations thereof are omitted here.

<Modifications>

The present invention has been explained in accordance with the above embodiment, however it is obvious that the present invention is not limited to the above embodiment, and the following modifications can also be implemented.

(1) In the above embodiment, although a pitch of the triple helix part 162*d* in the second area 1622 of the coil screw 162 is greater than that in the first area 1621, it is not limited to this. For example, a pitch of the triple helix part 162*d* in the second area 1622 may gradually become larger toward an upstream side in the toner conveyance direction (in −X direction), or a pitch in the first area 1621 and a pitch in the second area 1622 may be the same.

(2) In the above embodiment, although an inner surface of the cylindrical part 162*h* is smooth, it is not limited to this. The following describes other examples. Helical grooves may be formed on the inner surface of the cylindrical part 162*h* in a direction opposite to a direction of the triple helix part 162*d*, or one or more screw blades may be formed to stand on the inner surface of the cylindrical part 162*h* in the direction opposite to a direction of the triple helix part 162*d*. With this structure, for example, when there is little amount of toner left in the toner supply container 36, toner that exists inside the first cylindrical part 162*h*1 in the first area 1621 is conveyed to the second area 1622 by the above-mentioned grooves or blades, flows through an opening between blades of the triple helix part 162*d* to the outside of the second cylindrical part 162*h*2, and conveyed to the discharge opening 161*c* by the triple helix part 162*d*. This structure can decrease an amount of toner that remains inside the toner supply container 36 till the end without being conveyed to the discharge opening 161*c*, and realize efficient discharge of toner.

(3) In the above embodiment, a circumferential surface of the second cylindrical part 162*h*2 on which the triple helix part 162*d* is not formed is completely opened, and thus there are openings between adjacent blades of the triple helix part 162*d*. However, it may not be completely opened.

In this case, it is preferable that the openings in the circumferential surface of the second cylindrical part 162*h*2 are large enough to allow toner to pass therethrough so that toner existing inside the second cylindrical part 162*h*2 can flow through a space between adjacent blades of the triple helix part 162*d* to the outside of the second cylindrical part 162*h*2. For example, the circumferential surface of the second cylindrical part 162*h*2 may have an adequately open mesh structure.

(4) Alternatively, the second cylindrical part 162*h*2 may not be formed. That is to say, in the second area 1622, the triple helix part 162*d* may further extend helically in −X direction than an end of the first cylindrical part 162*h*1 in −X direction. In this case, adjacent blades of the triple helix part 162*d* are reinforced by being connected via ribs 162*k* and 162*m*, and a helical shape and a pitch of the triple helix part 162*d* are maintained constant.

(5) In the above embodiment, the first cylindrical part 162*h*1 has a continuous circumferential surface without openings, the structure of the first cylindrical part 162*h*1 is not limited to this. There may be one or more through-holes having sizes small enough not to substantially allow toner to pass therethrough.

(6) In the above embodiment, although the coil screw 162 conveys toner in one direction, it is not limited to this. The following describes other examples. That is to say, a coil screw that is made by connecting two different coil screws may be used. Specifically, helix directions of screw blades formed to stand on outer circumferential surfaces of the cylindrical parts 162*h* of the two different coil screws are different with each other. By rotating the coil screw having the above-mentioned structure, toner is conveyed from each end toward a center in a direction of an axis of the coil screw, or conveyed from the center toward each end in the direction of an axis of the coil screw. In both cases, the first cylindrical part 162*h*1 is positioned on a downstream side in a toner conveyance direction, and the discharge opening 161*c* may be provided at or around an end of a toner conveyance path. With this structure, since a position of the discharge opening 161*c* is not limited to one end of the coil screw in the direction of an axis of the coil screw, flexibility of a parts design and a layout can be improved.

(7) In the above embodiment, although a width of each blade of the triple helix part 162*d* is constant, it is not limited to this. The following describes another example. That is to say, by decreasing an inner diameter of a blade without decreasing an outer diameter thereof, widths of the blades of the triple helix part 162*d* in the second area 1622 may be larger than widths of the blades of the triple helix part 162*d* in the first area 1621. With this structure, an amount of toner remaining on an upstream side in a toner conveyance direction (−X direction) in the toner supply container 36Y can be reduced with the increased upstream conveyance force in the toner conveyance direction.

(8) In the above embodiment, when the toner supply container body 161 is cut along a plane perpendicular to a rotation axis of the coil screw 162, a bottom surface of the toner supply container body 161 is semi-circular in cross section (half cylindrical part 161*t*) and a center of the semicircle is the same as that of the rotation axis of the coil screw 162. However, the bottom surface of the toner supply container body 161 is not limited to be semi-circular (a central angle thereof does not have to be 180 degrees). Quantitative toner supply can be achieved as long as a part of an inner surface of the toner supply container body 161 has a cylindrical shape that includes at least a transverse dimension of the discharge opening 161*c* within its central angle.

(9) the above embodiment, although the cylindrical part 162*h* is a hollow cylinder, the structure of the cylindrical part 162*h* is not limited to this. The cylindrical part 162*h* may be a solid cylinder. In this case, although a maximum amount of toner contained inside the toner supply container body 161 may be reduced, quantitative toner supply can be achieved as in the case of the hollow cylinder. Note that it is desirable that a radius of the cylindrical part 162*h* be large enough not to allow toner existing in a repose angle of the discharge opening 161*c* to flow out from the discharge opening 161*c* due to its own weight.

(10) In the above embodiment, the image forming apparatus with the toner supply container pertaining to the present invention is specifically the tandem-type color digital printer. However, the image forming apparatus with the toner supply container pertaining to the present invention is not limited to the tandem-type color digital printer.

Regardless of whether image formation is performed in color or monochrome, the present invention is applicable to any toner supply container and any image forming apparatus that includes the toner supply container and supplies toner from the toner supply container to the developer by rotation of a helical conveyance member.

Also, the above embodiment and modifications can be combined with each other.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

Features and effects of the present invention are summarized below.

One aspect of the present invention is a toner supply container comprising: a container body that contains toner therein; and a conveyance member that is rotatably arranged inside the container body and conveys the toner toward a discharge opening of the container body when driven to rotate by external force, wherein the conveyance member includes (i) a cylindrical rotary body and (ii) a screw blade member that is wound around the cylindrical rotary body in such a manner that the screw blade member stands on an outer circumferential surface of the cylindrical rotary body, an inner surface of a bottom wall of the container body includes a cylindrically curved surface that is identical to a part of a circumferential surface of an imaginary cylinder whose axis is substantially the same as a rotation axis of the conveyance member, and a curvature radius of the cylindrically curved surface is set such that the conveyance member is driven to rotate in a state where an outer circumferential edge of the screw blade member substantially slides on the cylindrically curved surface.

With this structure, since the conveyance member is driven to rotate in a state where the outer circumferential edge of the screw blade member that is wound around the cylindrical rotary body substantially slides on the cylindrically curved surface included in the inner surface of the bottom wall of the container body, toner is trapped and conveyed in a space surrounded by adjacent blade members, the cylindrically curved surface, and the outer circumferential surface of the cylindrical rotary body. As a result, an amount of delivered toner per unit rotation of the conveyance member can be constant, and an amount of toner supplied to a developer can be easily controlled.

Another aspect of the present invention is the toner supply container, wherein the cylindrical rotary body may be hollow and include (i) a first cylindrical part that is located on a downstream side in a toner conveyance direction and has a continuous circumferential surface and (ii) a second cylindrical part that is located on an upstream side in the toner conveyance direction and has one or more openings in a circumferential surface thereof.

With this structure, toner existing inside the hollow cylindrical rotary body and on an upstream side in the toner conveyance direction can freely move to the outside of the cylindrical rotary body, while ensuring a space to contain toner inside the hollow cylindrical rotary body. By the screw blade member conveying the toner to the discharge opening, an amount of remaining toner without being discharged from the toner supply container can be reduced.

Another aspect of the present invention is the toner supply container, wherein the screw blade member may helically extend further upstream in a toner conveyance direction than an upstream end of the cylindrical rotary body.

With this structure, toner can freely move through openings between adjacent blade members in the extending part of the screw blade member inside which the cylindrical rotary body is not formed. By the screw blade member conveying the toner to the discharge opening, an amount of remaining toner without being discharged from the toner supply container can be reduced.

Another aspect of the present invention is the toner supply container, wherein a pitch of the screw blade member on the first cylindrical part may be substantially constant.

Another aspect of the present invention is the toner supply container, wherein a pitch of the screw blade member on the cylindrical rotary body may be substantially constant.

This structure can prevent a change in toner density that occurs by applying an unnecessary pressure to toner trapped in a space surrounded by the adjacent blade members, the cylindrical curved surface, and the outer circumferential surface of the cylindrical rotary body. And an amount (weight) of discharged toner per rotation of the conveyance member can be maintained constant.

Another aspect of the present invention is the toner supply container, wherein a pitch of the screw blade member located on a downstream side in a toner conveyance direction may be smaller than a pitch of the screw blade member located on an upstream side in the toner conveyance direction.

With this structure, since an amount of toner transmitted per rotation of the conveyance member becomes larger on an upstream side than on a downstream side in the toner conveyance direction, toner existing on the upstream side in the toner conveyance direction can be quickly conveyed downstream. Therefore, toner can be stably discharged until the toner supply container is replaced.

Another aspect of the present invention is the toner supply container, wherein the discharge opening may be provided in either the bottom wall or a side wall of the container body, and at or around an end of a toner conveyance path.

With this structure, since an amount of remaining toner in the container body without being discharged can be reduced as much as possible, and user convenience can be improved because replacement of the toner supply container can be postponed.

Another aspect of the present invention is the toner supply container, wherein the discharge opening may be provided in the bottom wall of the container body and in the cylindrically curved surface.

Another aspect of the present invention is the toner supply container, wherein the discharge opening may be provided in the side wall of the container body and, when the container body is viewed along a direction of the rotation axis of the conveyance member, within a range between the outer circumferential surface of the cylindrical rotary body and the cylindrically curved surface.

This structure prevents toner existing inside the cylindrical rotary body from flowing out from the discharge opening due to its own weight. Since only toner conveyed by the screw blade member is discharged from the discharge opening, an amount of discharged toner can be controlled more strictly.

Also, the present invention may be an image forming apparatus that includes a toner supply container having the above-mentioned features. In this case, a similar effect can be achieved.

The present invention can be broadly applied to an image forming apparatus that supplies toner from a toner supply container to a developer by rotation of a helical conveyance member.

What is claimed is:

1. A toner supply container comprising:

a container body that contains toner therein; and a conveyance member that is rotatably arranged inside the container body and conveys the toner toward a discharge opening of the container body when driven to rotate by external force, wherein the conveyance member includes (i) a hollow cylindrical rotary body that allows toner to pass through the cylindrical rotary body; and (ii) a screw blade member that is wound around the cylindrical rotary body in such a manner that the screw blade member stands on an outer circumferential surface of the cylindrical rotary body and helically extends further upstream in a toner conveyance direction than an upstream end of the cylindrical rotary body, the outer circumferential surface of the cylindrical rotary body extends in an axial direction of the toner supply container, and the screw blade member contacts the outer circumferential surface of the cylindrical rotary body as the screw blade member winds around the cylindrical rotary body, an inner surface of a bottom wall of the container body includes a cylindrically curved surface that is identical to a part of a circumferential surface of an imaginary cylinder whose axis is substantially the same as a rotation axis of the conveyance member, and a curvature radius of the cylindrically curved surface is set such that the conveyance member is driven to rotate in a state where an outer circumferential edge of the screw blade member substantially slides on the cylindrically curved surface.

2. The toner supply container of claim 1, wherein a pitch of the screw blade member on the cylindrical rotary body is substantially constant.

3. The toner supply container of claim 1, wherein a pitch of the screw blade member located on a downstream side in a toner conveyance direction is smaller than a pitch of the screw blade member located on an upstream side in the toner conveyance direction.

4. The toner supply container of claim 1, wherein the discharge opening is provided in either the bottom wall or a side wall of the container body, and at or around an end of a toner conveyance path.

5. The toner supply container of claim 4, wherein the discharge opening is provided in the bottom wall of the container body and in the cylindrically curved surface.

6. The toner supply container of claim 4, wherein the discharge opening is provided in the side wall of the container body and, when the container body is viewed along a direction of the rotation axis of the conveyance member, within a range between the outer circumferential surface of the cylindrical rotary body and the cylindrically curved surface.

7. An image forming apparatus comprising:

a developer operable to develop an electrostatic latent image on an image carrier with use of toner; and a toner supply container that contains therein the toner to supply to the developer, wherein the toner supply container includes:

a container body that contains the toner therein; and a conveyance member that is rotatably arranged inside the container body and conveys the toner toward a discharge opening of the container body when driven to rotate by external force, wherein the conveyance member includes (i) a hollow cylindrical rotary body that allows toner to pass through the cylindrical rotary body; and (ii) a screw blade member that is wound around the cylindrical rotary body in such a manner that the screw blade member stands on an outer circumferential surface of the cylindrical rotary body and helically extends further upstream in a toner conveyance direction than an upstream end of the cylindrical rotary body, the outer circumferential surface of the cylindrical rotary body extends in an axial direction of the toner supply container, and the screw blade member contacts the outer circumferential surface of the cylindrical rotary body as the screw blade member winds around the cylindrical rotary body, an inner surface of a bottom wall of the container body includes a cylindrically curved surface that is identical to a part of a circumferential surface of an imaginary cylinder whose axis is substantially the same as a rotation axis of the conveyance member, and a curvature radius of the cylindrically curved surface is set such that the conveyance member is driven to rotate in a state where an outer circumferential edge of the screw blade member substantially slides on the cylindrically curved surface.

8. The image forming apparatus of claim 7, wherein a pitch of the screw blade member on the cylindrical rotary body is substantially constant.

9. The image forming apparatus of claim 7, wherein a pitch of the screw blade member located on a downstream side in a toner conveyance direction is smaller than a pitch of the screw blade member located on an upstream side in the toner conveyance direction.

10. The image forming apparatus of claim 7, wherein the discharge opening is provided in either the bottom wall or a side wall of the container body, and at or around an end of a toner conveyance path.

11. The image forming apparatus of claim 10, wherein the discharge opening is provided in the bottom wall of the container body and in the cylindrically curved surface.

12. The image forming apparatus of claim 10, wherein the discharge opening is provided in the side wall of the container body and, when the container body is viewed along a direction of the rotation axis of the conveyance member, within a range between the outer circumferential surface of the cylindrical rotary body and the cylindrically curved surface.

* * * * *